United States Patent [19]

Broadwater

[11] Patent Number: 4,459,209

[45] Date of Patent: Jul. 10, 1984

[54] MATERIAL COLLECTOR FOR FLUID CONTAINER HAVING BOTTOM OUTLET

[76] Inventor: Daniel W. Broadwater, 1844 Camino de los Robles, Menlo Park, Calif. 94025

[21] Appl. No.: 369,325

[22] Filed: Apr. 16, 1982

Related U.S. Application Data

[63] Continuation of Ser. No. 196,907, Oct. 14, 1980, abandoned.

[51] Int. Cl.[3] ..... E04H 3/20; B01D 35/02

[52] U.S. Cl. ..... 210/169; 210/237; 210/299; 210/416.2; 210/470

[58] Field of Search ..... 210/169, 172, 235, 237, 210/299, 312, 407, 416.2, 470, 482

[56] References Cited

U.S. PATENT DOCUMENTS

| | | | |
|---|---|---|---|
| 436,114 | 9/1890 | Baker | 210/407 X |
| 1,225,993 | 5/1917 | Mullaney | 210/299 |
| 1,664,435 | 4/1928 | Smith | 210/470 X |
| 2,193,508 | 3/1940 | Cordts | 210/235 X |
| 3,003,169 | 10/1961 | Forrester | 210/169 X |
| 3,091,340 | 5/1963 | Pansini | 210/169 X |
| 3,254,770 | 6/1966 | Herndon | 210/482 X |
| 3,321,080 | 5/1967 | Pansini et al. | 210/169 X |
| 3,469,700 | 9/1969 | Johnson | 210/169 X |
| 3,643,802 | 2/1972 | Jackson, Jr. | 210/172 |
| 3,667,611 | 6/1972 | Pansini | 210/169 X |
| 3,820,182 | 6/1974 | Vockroth | 210/172 X |
| 3,828,931 | 8/1974 | Henricksen | 210/169 X |
| 3,839,749 | 10/1974 | Blumenfeld et al. | 210/169 X |
| 3,932,281 | 1/1976 | Pansini | 210/169 X |
| 4,206,054 | 6/1980 | Moore et al. | 210/169 |

*Primary Examiner*—Robert H. Spitzer
*Attorney, Agent, or Firm*—John L. McGannon

[57] ABSTRACT

A material collector for a fluid container having a bottom drain outlet, such as a swimming pool. The collector includes an open top receptacle provided with a perforate side wall or bottom wall. An imperforate skirt extends outwardly and downwardly from the upper margin of the side wall and has an outer periphery spaced from the side wall for engaging the bottom of the fluid container when the receptacle is spaced above the drain outlet. A dome-shaped cover above the receptacle forms a duct with the skirt to permit material, such as debris, to be swept by the flow of the fluid of the container into the open top of the receptacle where the receptacle collects the material as the fluid continues to flow through the perforate wall of the receptacle and into the drain outlet of the container therebelow. A post or line releasably coupled to the receptacle permits the receptacle and the cover to be lifted together out of the fluid in the container and emptied. The post or line is shiftably mounted in a hole in the cover so that the receptacle and the skirt move into engagement with the cover to close the receptacle as the receptacle is lifted a short distance by the post or line. Then the post or line, with the receptacle covered, is lifted until the receptacle and cover are out of the fluid in the container, whereupon the post or line can be releasably separated from the receptacle to facilitate emptying of the receptacle. During use, a differential pressure exists across the perforate wall of the receptacle because of fluid flow through the porous wall to cause the outer periphery of the skirt to be in sealing engagement with the bottom of the container.

10 Claims, 4 Drawing Figures

MATERIAL COLLECTOR FOR FLUID CONTAINER HAVING BOTTOM OUTLET

This is a continuation of application Ser. No. 196,907, filed Oct. 14, 1980, now abandoned.

This invention relates to improvements in collectors for particulate material flowing in a fluid and, more particularly, to a collector for trapping particulate material, such as debris, in a fluid container, such as a swimming pool.

BACKGROUND OF THE INVENTION

The use of debris collectors near the drain oulet of a swimming pool is well known. The purpose of such a collector is to trap leaves, twigs, dirt particles and other foreign material which would otherwise pass into the fluid line and pump system used for circulating the water in the pool and cause the line and pump to become clogged or to require frequent cleaning. Typical of debris collectors for swimming pools are those disclosed in the following U.S. Pat. Nos. 3,321,080; 3,667,611; 3,828,931; 3,839,749; and 3,932,281.

For the most part, the collectors of these patents are complex in construction or require that the drain plate covering the drain outlet in the bottom of a swimming pool be removed to permit mounting the collector partially in the drain outlet for operation. Both of these drawbacks are undesirable because of the cost of production of collectors and the difficulty in fitting the collectors in the drain outlets and in removing the collectors for cleaning purposes. A need has therefore arisen for an improved debris collector for a swimming pool and for other uses in which the collector is simple and rugged in construction, made of a relatively few number of parts, and can be used without modification of the swimming pool or fluid container in which the collector is used.

SUMMARY OF THE INVENTION

The present invention satisfies the aforesaid need by providing a material collector for a fluid container having a drain outlet in its bottom wherein the collector itself is made up of only three parts, namely a materials-receiving receptacle, a cover and a lifting post or line for lifting the receptacle and cover out of the fluid container in which it is used. The receptacle has an open top and perforate side or bottom wall. An imperforate skirt extends outwardly and downwardly from a location near the upper margin of the perforate wall so that the outer periphery of the skirt can engage the bottom of the fluid container in which the collector is used. Thus, when the receptacle is in an operative position spaced above but in proximity to the drain outlet in the bottom of the fluid container, the skirt and perforate wall define a closed space communicating with the interior of the receptacle through the perforate wall yet this space communicates with the drain outlet of the container. By virtue of this construction, a differential pressure will exist across the perforate wall of the receptacle as fluid passes through the perforate wall, through the closed space beneath the skirt, and into the drain outlet. This differential pressure causes the receptacle to remain in a fixed position above the fluid outlet so that no external hold-down means is required for this purpose.

The cover has a hollow interior and preferably is dome-shaped. The cover is normally spaced above the receptacle to form a duct of relatively small cross-sectional area which allows fluid and solid material to flow into the open top of the receptacle. This is accomplished even though the duct extends upwardly to the open top of the receptacle. The reason for this is that a Venturi effect is caused by the flow of fluid through the relatively small cross-section of the duct.

The lifting post or line allows elevation of the receptacle a short distance relative to the cover during initial lifting of the receptacle so that the receptacle moves into engagement with the cover to close the open top of the receptacle. This action traps the material collected in the receptacle. Then, the closed receptacle can continue to be lifted out of the container and emptied of the material collected therein.

The primary object of this invention is to provide an improved material collector for a fluid container having a drain outlet in the bottom thereof wherein the collector is held in a fixed position over the drain outlet without the need for external hold-down means and can be lifted out of the container without spilling the material collected thereby, all of which is accomplished with a relatively few number of parts and without the need for modifying the container.

Another object of the present invention is to provide a debris collector for a swimming pool having a drain outlet in the bottom thereof wherein the collector has an open top receptacle with a perforate wall and an imperforate skirt engageable with the pool bottom to cause a differential pressure to exist across the perforate wall when water flows therethrough which holds the receptacle in place above the drain outlet yet the receptacle filters debris from the water flow and traps the debris so that it can later be lifted out of the pool and thrown away.

Other objects of the present invention will become apparent as the following specification progresses, reference being had to the accompanying drawing for an illustration of the embodiment of the invention.

Figure 1:
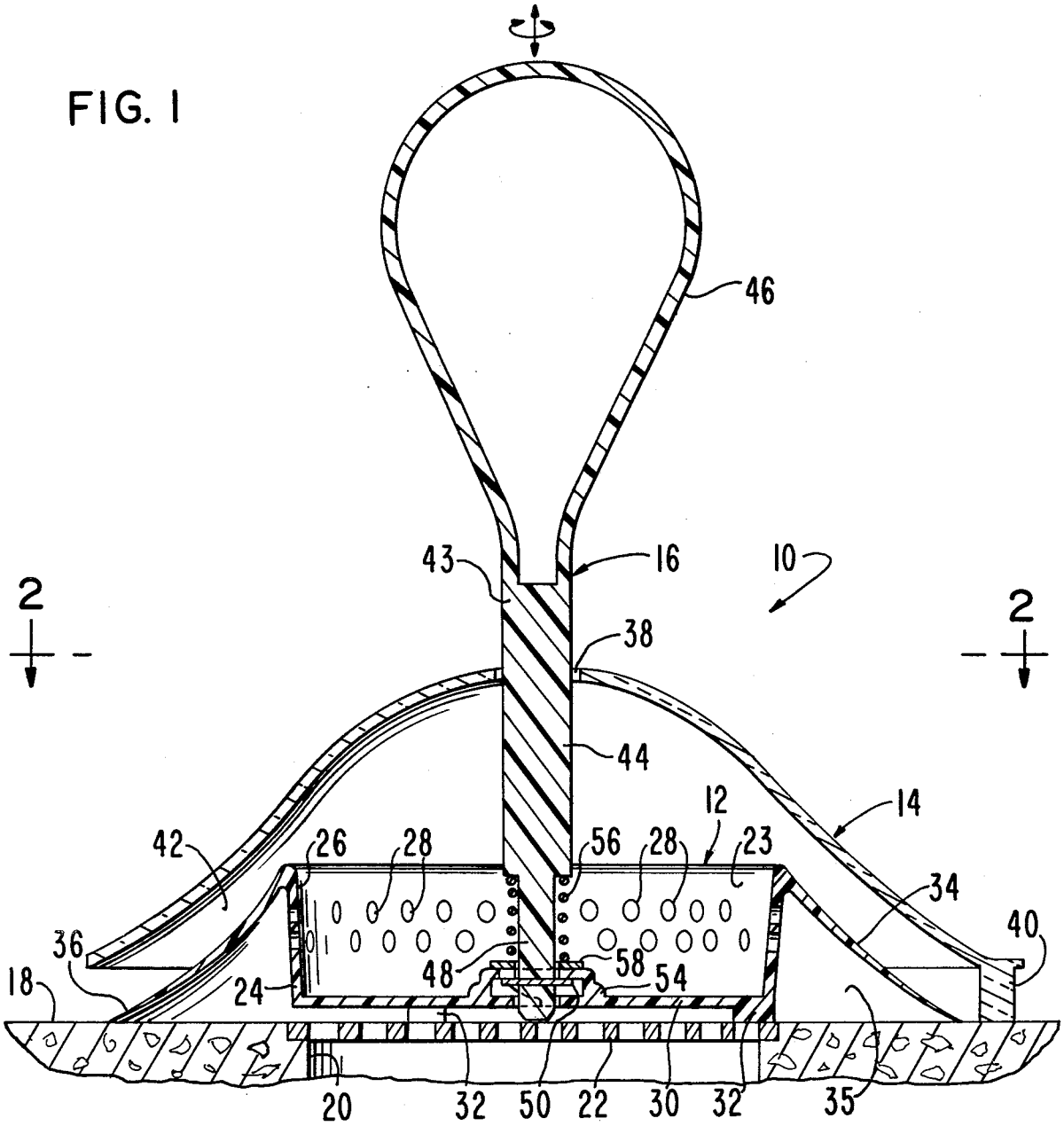
FIG. 1 is a vertical section through the material collector of the present invention.

The material collector of the present invention is broadly denoted by the numeral 10 and is basically made up of three parts, namely a receptacle 12, a cover 14 above receptacle 12, and a retrieving device 16 for coupling receptacle 12 with cover 14. Collector 10 is adapted to be used in any type of liquid containing tank which has a drain outlet at the bottom thereof. For purposes of illustration, collector 10 will be hereinafter described as being used with a swimming pool having a bottom 18, a drain outlet 20 and a drain grate 22 covering the open top of passage 20 as shown in FIG. 1.

Receptacle 12 has an open top 23 having a generally circular side wall 26 provided with holes 28 therethrough to render it perforate. Receptacle 12 has an imperforate bottom 30 which is integral with side wall 26. In the alternative, side wall 26 could be imperforate and bottom wall 30 could be perforate.

Figure 4:
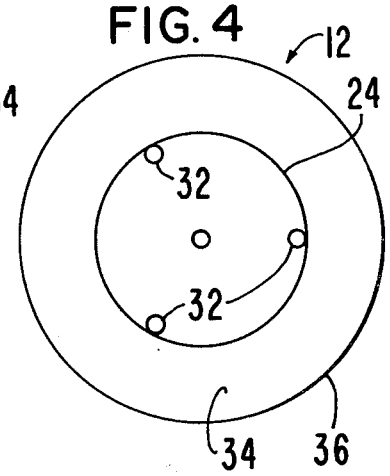
FIG. 4 is a bottom plan view of the receptacle of FIG. 3.

Bottom 30 has a number of spaced projections 32 on its lower surface in the manner shown in FIGS. 1 and 4. Projections 32 define legs which support receptacle 24 above and slightly spaced from drain grate 22 so that water can pass beneath the receptacle and through the drain grate into drain outlet 20 as the water is circulated through the pool.

An annular, inclined skirt 34 is integral with the upper, annular margin of receptacle 12 and extends outwardly and downwardly therefrom. Skirt 34 has an annular seal 36 at its outer periphery, seal 36 being formed of a suitable resilient material, such as rubber, neoprene or the like. The seal 36 is adapted to engage bottom 18 of the swimming pool in sealing relationship thereto. Thus, side wall 26 and skirt 34 form an annular, closed space 35 communicating with drain outlet 20.

Receptacle 12 can be made of any suitable material. For purposes of illustration, it is formed of a plastic material which can be molded so that side wall 26, bottom 30 projections 32 and skirt 34 are integral with each other to form a one-piece construction. In fact, seal 36 can be integral with skirt 34 or can be of a different material from wall 34. If seal 36 is separate from skirt 34, the seal is bounded to the skirt in any suitable manner, such as with a suitable plastic adhesive.

Cover 14 is dome-shaped and may be transparent to permit viewing of debris in receptacle 12. The cover has a central hole 38 therethrough for retrieving device 16. The hole is oversized relative to the transverse dimension of the device 16 so that the device can move up and down in the hole.

Figure 2:
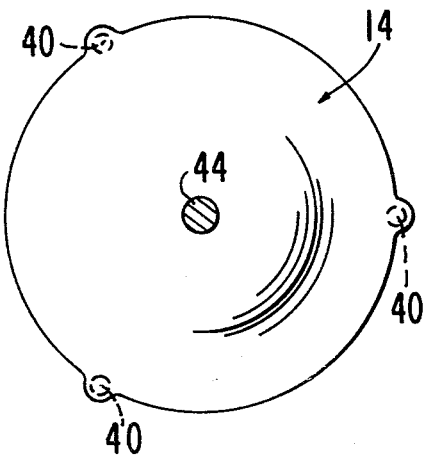
FIG. 2 is a cross-sectional view taken along line 2—2 of FIG. 1, the view being on a reduced scale.
Figure 3:
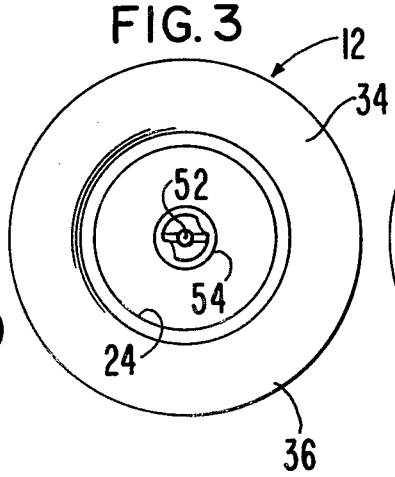
FIG. 3 is a top plan view of a receptacle of the present invention.

The outer periphery of cover 14 is circular as shown in FIG. 2. A number of legs 40 are secured to cover 14 at its outer periphery as shown in FIG. 2. These legs are adapted to be supported on bottom 18 of the swimming pool and the height of the legs is such that, when the legs 40 engage surface 18, cover 14 is spaced above skirt 34 to present an annular duct 42 (FIG. 1) which allows water in the pool to flow into the open top of receptacle 24 when the latter is spaced above drain grate 22 by legs 32 as shown in FIG. 1. Cover 14 and skirt 34 are shaped to cause the duct to have a relatively small cross-sectional area so that a Venturi effect will be produced in the duct to assist in overcoming gravitational forces and to allow debris, such as leaves, twigs, dirt and the like to flow from the pool into and upwardly through the duct and into the open top of the receptacle. In this way, the debris is collected in the receptacle while the water continues to flow through side wall 26 and into and through the drain passage 20.

As liquid flows through side wall 26, a differential pressure is developed across the side wall. This differential pressure is due to the pressure drop caused by the flow of water through side wall 26, through space 35 and into drain outlet 20. The greater pressure is on the upstream side of side wall 26; thus, the reduced fluid pressure in space 35 assures that the water pressure above skirt 34 will press the skirt downwardly and thereby releasably hold seal 36 against bottom 18. This action secures receptacle in a fixed position over drain outlet 20 and eliminates any need for a separate hold-down means and further eliminates any need to have a portion of receptacle 12 extend into drain outlet 20, as required in most conventional debris collectors for swimming pools. If bottom 30 is perforate, the above-mentioned pressure drop will be across it.

Retrieving device 16 includes a rigid post having lower cylindrical part 44 and an upper loop 46 which can be integral with part 44 or rigidly secured thereto in any suitable manner. Part 44 has a reduced segment 48 provided with a pin 50 therethrough near the lower end thereof. Segment 48 and pin 50 are adapted to be inserted into a bayonet slot 52 in a projection 54 integral with bottom 30 of receptacle 12. A coil spring 56 surrounds segment 48 and bears against a washer 58 slidably received on segment 48.

When pin 50 is releasably coupled to projection 54, receptacle 12 and cover 14 can be raised together and away from drain grate 22 to the surface, and receptacle 12 can then be separated from cover 14 to clean the debris out of receptacle 12. Post 16 is rotated so that pin 50 can be removed from slot 52 to thereby allow receptacle 12 to be separated from member 14 for cleaning purposes.

Retrieving device could be a flexible line instead of a rigid post as described above. The line preferably would be buoyant and have a loop at its upper end. Its lower end would have a connecting means, such as pin 50, for insertion into slot 52 as described above.

In use, collector 10 is mounted over drain grate 22 in the manner shown in FIG. 1. During this time, water continuously flows through duct 42, into receptacle 12 and through side wall 26 to drain outlet 20. Typically in a swimming pool, a pump is coupled with drain outlet 20 to draw the water out of the pool, through a filter or heater, and then back into the pool. This movement of the water is substantially continuous and, during this time a pressure difference exists across the side wall 26, holding seal 36 in sealing engagement with bottom 18 of the swimming pool. The debris in the pool is carried by the water flow and drawn upwardly through duct 42 and collected in receptacle 12.

When it is desired to empty receptacle 12, a hook on the end of a pole is inserted into the water and in loop 46. Then the loop is raised relative to cover 14 until skirt 34 engages the lower surface of cover 14. This closes the open top of receptacle 12 and traps the debris therein. Receptacle 12 and cover 14 are then lifted as a unit to the surface and post 16 is separated from receptacle 12 to allow emptying of the receptacle.

To replace collector 10 over the drain grate 22, the collector is lowered to bottom 18 by a pole hooked to loop 46 until receptacle 12 overlies drain plate 22. When this occurs, seal 36 engages bottom 18 and legs 40 of cover 14 position cover 14 above skirt 34 to form duct 42 so that collector 10 is once again operational.

Only a very small pressure difference is required across side wall 26 to keep the collector in place. For a flow of 15 GPM across side wall 26 having thirty-six ¼" holes, the pressure difference is about 0.027 psi. In such a case, receptacle 12 remains fixed in place and will not move from its position overlying drain plate 22.

I claim:

1. A material collector for a fluid container having a bottom provided with a drain outlet comprising: a receptacle having an open top, an upper margin and a perforate side wall, said receptacle adapted to be placed in an operative position in proximity to and above said drain outlet of the container and to receive material therein through the open top thereof, said side wall permitting a fluid in the receptacle to flow therethrough and into the drain outlet when the receptacle is in said operative position and as the receptacle receives and holds material therein; an annular imperforate skirt having a continuous inner periphery secured to the upper margin of said side wall and extending outwardly and downwardly therefrom, said skirt having a continuous outer periphery engagable with said bottom for forming a closed space exteriorly of the side wall and communicating with said drain outlet when the receptacle is in said operative position, whereby a fluid pressure difference will exist across said wall when fluid flows out of said container through said space and into said fluid outlet; means coupled with the receptacle for lifting the same away from said operative position; and a cover shiftably coupled with said lifting means for closing the open top of the receptacle when the latter is being lifted, said cover being in overlying relationship to said skirt, there being spacer means for spacing the cover above the skirt when the receptacle is in said operative position so that the skirt and the cover form a duct communicating with the open top of the receptacle, said duct having a generally continuous entrance opening and being of a height to provide a Venturi effect as fluid flows therethrough.

2. A material collector as set forth in claim 1, wherein said receptacle has a number of spaced legs for supporting the same above and spaced from said drain outlet.

3. A material collector as set forth in claim 1, wherein said cover is dome-shaped and has a number of spaced legs defining said spacer means, said skirt being moveable into engagement with the cover when the receptacle is lifted to thereby close said duct to trap material in said receptacle.

4. A material collector as set forth in claim 3, wherein the cover has an outer peripheral edge, said legs being legs secured to the cover adjacent to said outer peripheral edge thereof.

5. A material collector as set forth in claim 3, wherein said cover is transparent.

6. A material collector as set forth in claim 1, wherein said lifting means includes a post releasably coupled to said receptacle.

7. A material collector as set forth in claim 6, wherein said cover has a central hole for shiftably receiving the post, the post having a loop at its upper end.

8. A material collector as set forth in claim 1, wherein said lifting means includes a flexible line.

9. A material collector as set forth in claim 8, wherein said line is buoyant.

10. A debris collector for a swimming pool having a bottom provided with a drain outlet comprising: a receptacle having an open top, an upper margin and a side wall, said receptacle adapted to be placed in an operative position spaced above and aligned with said drain outlet and to receive debris therein through the open top thereof, said side wall being perforate to permit water to flow through the side wall and into the drain outlet when the receptacle is in said operative position; and annular, imperforate skirt coupled with said side wall at the upper margin thereof and extending outwardly and downwardly therefrom, said skirt having an outer periphery engagable with said bottom in substantially sealing relationship thereto for forming an annular, closed space exteriorly of and adjacent to the side wall and communicating with said drain outlet when the receptacle is in said operative position, whereby a fluid pressure difference will exist across said side wall when fluid flows out of said swimming pool through said drain outlet; a post releasably coupled with the receptacle for lifting the receptacle away from said operative position; and a dome-shaped cover coupled with said post above the receptacle, said cover being in overlying relationship to said skirt and said receptacle and having a number of spaced legs for engaging the bottom to space the cover above the receptacle and the skirt when the receptacle is in said operative position, whereby the space between the cover and the skirt defines a duct for the flow of water and debris toward and into the open top of the receptacle, said duct having a circular entrance opening and being of a height to provide a Venturi effect as fluid flows therethrough, said post being shiftable relative to said cover to cause the cover to close the open top of the receptacle as the latter is lifted away from said operative position.

* * * * *